US005509870A

United States Patent [19]

Lloyd

[11] Patent Number: 5,509,870

[45] Date of Patent: Apr. 23, 1996

[54] VARIABLE RESISTANCE SLIDE BOARD

[76] Inventor: Stephen N. Lloyd, 219 Warfield Dr., Newark, Del. 19713

[21] Appl. No.: 61,018

[22] Filed: May 14, 1993

Related U.S. Application Data

[63] Continuation-in-part of Ser. No. 871,129, Apr. 20, 1992, abandoned.

[51] Int. Cl.[6] ..... A63B 22/00

[52] U.S. Cl. ..... 482/51; 482/13; 482/148; 472/90; 434/253

[58] Field of Search ..... 482/51, 13, 71, 482/148; 472/118, 116, 88, 90; 434/253; 273/285, 286, 287

[56] References Cited

U.S. PATENT DOCUMENTS 4,779,862 10/1988 Keppler .
4,940,226 7/1990 Carra .
5,114,387 5/1992 Keppler ..... 482/51
5,133,700 7/1992 Braathen ..... 472/118

*Primary Examiner*—Kien T. Nguyen
*Attorney, Agent, or Firm*—Connolly & Hutz

[57] ABSTRACT

A variable resistance slide board comprises a thin flexible sheet having a low friction upper surface. The sheet may include start-stop blocks located on the sides or elsewhere for engaging the foot or hands of the user while starting or pushing and while stopping. The start-stop blocks may be permanently attached or adjustably mounted. The sheet is mounted on a compressible mat. Additionally, the sheet is made from a deformable material so that the resistance can be controlled in accordance with the characteristics of the compressible mat.

47 Claims, 4 Drawing Sheets

VARIABLE RESISTANCE SLIDE BOARD

CROSS REFERENCE TO RELATED APPLICATION

This application is a continuation in part of application Ser. No. 871,129, filed Apr. 20, 1992 now abandoned.

BACKGROUND OF THE INVENTION

Slide boards have been used as exercise devices by, for example, speed skaters or other athletes. Generally such slide boards include a slide surface with side bumpers. In use, the skater practices various foot strokes to increase strength and technique.

Olympic speed skaters, figure skaters, hockey players and skiers have demonstrated the efficacy of the slide board when training for the Olympics. Their device was simply a piece of plastic/formica countertop laminate with a piece of beveled two by four attached to each end. The purpose of the bevel was to reduce stress on the outside of the foot. Adjustment of the distance between the two by four end pieces was accomplished by drilling holes in the countertop and fitting one of the end pieces with pins which were inserted in the holes. The athletes wore terry cloth booties or heavy wool socks and pushed themselves from end to end closely approximating the movements utilized while training on an ice surface.

The significant shortcoming of this apparatus was the size and weight which made it awkward and dangerous to move. The base was particle board, a very dense material, with adhesive securing the formica gliding surface. Additionally, it was necessary to anchor the ends of the board to limit side to side movement with people, heavy weights, or a wooden frame.

Keppler, U.S. Pat. No. 4,779,862, discloses the entire countertop prototype which Olympians used with enhancements. Keppler's invention treats the base and gliding surface as separate elements, and thereby eliminates the adhesive which held the gliding surface to the base in the Olympians countertop prototype. The Keppler base is cut into sections and hinged while the plastic glide surface is rolled to improve movability. There is still significant weight for the total material package of the Keppler device as the only material eliminated was the glue while a much thicker, 0.375 inch gliding surface, replaced the thin formica used by the Olympians. Moreover, due to the flexible nature of the hinged base and its elevation, it is probably necessary to support the structure between the bumpers attached to each end and some type of anti-skid capability is apparently required to limit side to side travel of the apparatus. Thus, the devices used by the Olympians, and by Keppler have disadvantages with regard to set-up and transportation.

There are several devices on the market presently with constructions similar to Braathen, U.S. Pat. No. 5,133,700. Braathen refers to a gliding surface made of linoleum with a friction coating on the underside and start stop blocks attached to each end. Linoleum and the surfaces used in the similar constructions are typically at least 0.060 inches to 0.070 inches thick. These materials remain effectively rigid as the user slides across them. These materials are rigid enough to allow the device to be used on a surface such as padded carpet without buckling or wrinkling. With regard to flexibility, the only requirement is that the devices can be rolled up for storage.

Braathen and Carra, U.S. Pat. No. 4,940,226 incorporate adjustability into the end piece by squeezing the gliding surface between upper and lower members. Importantly, the members clamp the sliding surface when tightened by a vertically oriented releasable mechanism. Typically, the devices on the market using this design are ineffective. The end pieces move outwardly during use. This outward movement occurs when the lateral or horizontal forces generated by the exerciser are greater than the vertical forces applied by the releasable vertical connecting mechanisms as they clamp the upper and lower longitudinal members. It also appears that the concave-convex interlocking of the upper and lower members described by Braathen, column 2 line 12, would emboss the plastic sliding surface thereby leaving permanent distortion. Braathen's bottom support flange would also tend to move as there is no mention of any friction material to hold it in place.

SUMMARY OF THE INVENTION

The principal object of the invention is to develop a surface which has variable resistance thereby allowing the exerciser to increase or decrease the amount of effort required for the exercise. When used with end blocks the variable resistance of such a surface will increase or decrease the velocity and travel during glide related to a fixed push-off force.

It is also an object of this invention to provide a device which is simple, inexpensive, and portable. Simple, for example, means that the device can be removed from storage and made operational within a few moments on most firm floor surfaces such as concrete, hardwood, vinyl tile, rubber matting, and so forth. In rehabilitation where start and stop forces are relatively low the device may be used without support on a padded element such as carpet. However, in an athletic environment where the forces are greater, the device may be used on a padded element such as carpet if it is supported by a rigid element such as plywood or rigid plastic.

Another object is to minimize side to side movement of the apparatus thereby eliminating the requirement to have people or weighted objects at each end.

A further object of the device is to provide a device which provides low impact exercise.

Also, it is an object of the invention to provide a means for adjusting the distance between the end pieces.

An additional object is to provide a multi-directional device.

The foregoing objects can be accomplished by utilizing a thin sheet of plastic as the gliding surface. The plastic sheet may have start-stop blocks permanently attached to said sheet or start-stop blocks that allow for adjusting the distance between said start-stop blocks. Start-stop blocks may be positioned in various patterns to allow for multi-directional movement. The deformable gliding sheet with or without start-stop blocks is then placed on a mat which allows for the desired level of resistance, side to side stability, and impact dissipation. The plastic gliding surface and mat also form an effective resistance surface which can be used without start-stop blocks. It is paramount to distinguish the characteristics of the plastic film used in the disclosed device from plastic sheets used in prior devices. Prior devices use a sheet that is flexible enough to roll for storage. The plastic used in prior devices is approximately a minimum five times thicker and significantly more rigid than the sheet used in the disclosed device. The plastic sheet disclosed herein is supple to the extent that it will conform to the compressible mat. Equally important, the underlying mat in Braathen's device functions only as friction material. There is no reference to compressibility of the mat as disclosed herein, and furthermore, to the gliding surface being supple and deforming instantaneously to the compressible mat when a load is applied.

THE DRAWINGS

DETAILED DESCRIPTION

Figure 1:
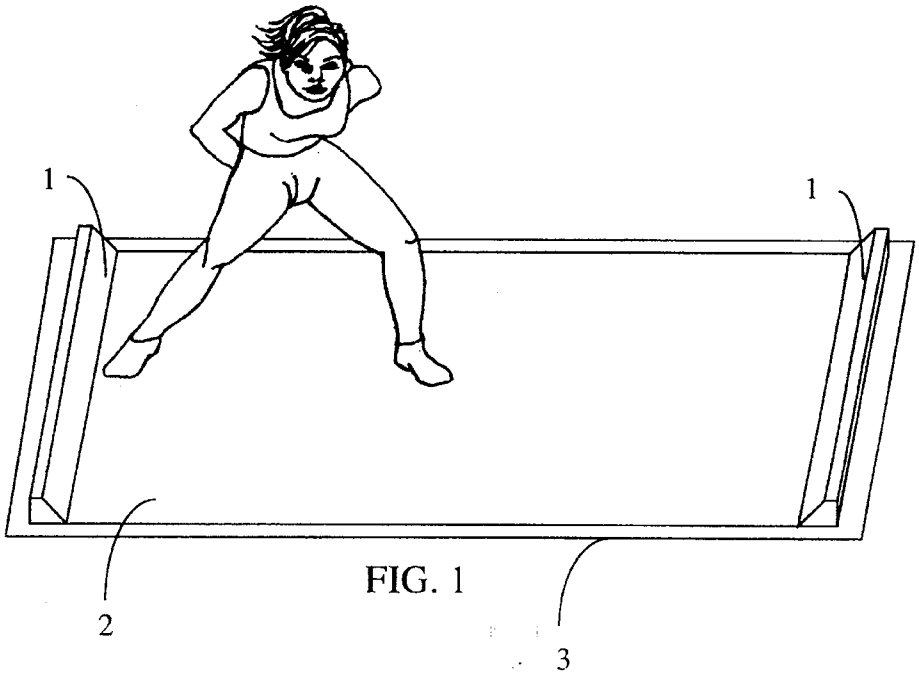
FIG. 1 is a pictorial illustration depicting the use of the device of this invention with start-stop blocks.
Figure 2:
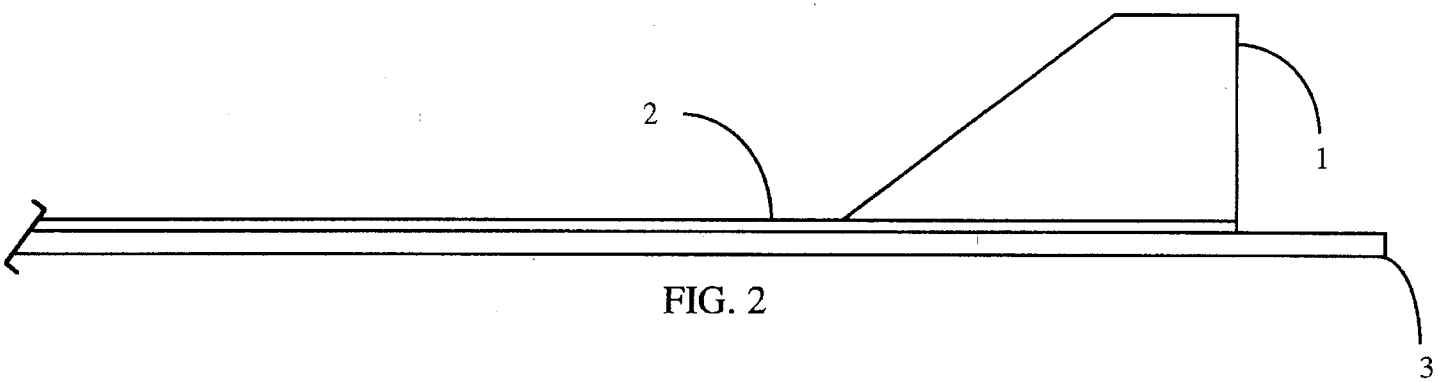
FIG. 2 is an elevational view of a portion of the device shown in FIG. 1.

As shown in FIG. 1 the variable resistance slide board of this invention includes a gliding surface 2. Each end of the gliding surface 2 includes a start-stop block 1. Block 1 is the piece against which the exerciser pushes on to move across the gliding surface 2 and stops against when the opposite side is reached. The gliding surface with blocks is placed on a mat 3 which may be changed to provide the desired hardness/compression-deflection values thereby allowing the user to increase or decrease the force required to glide across the board. The device can be constructed to have any number and arrangement of start-stop blocks. For example, hexagonal, octagonal, "L" shaped, and circular designs appear to have utility.

Figure 3:
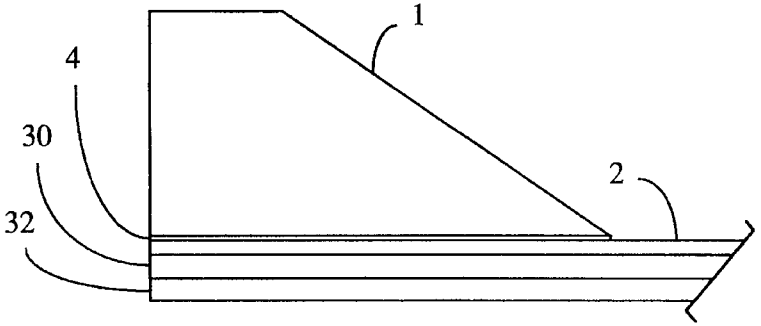
FIG. 3 is an enlarged fragmentary view illustrating how a start-stop block and glide sheet are connected.

As shown in FIG. 3 a bonding agent 4 is between the gliding sheet 2 and the start-stop block I to form a fixed unit which may be detachably mounted on mat 3.

FIG. 3 also shows the mat 3 mounted on a firm base 30 which is disposed over a padded member 32. The padded member is preferably a carpet and the firm base is made of wood or rigid plastic.

As indicated the start-stop block 1 is attached to each end or side against which the user pushes to start the movement and stops after gliding across to the opposite side. The block 1 may be 1.75 inches thick with an angle of 35 degrees and an overall base width measurement of 3.5 inches. The thickness, width, length, and contour, particularly the slope if desired where the foot contacts the block, can be adapted to the requirements of the board. For example, the parameters will vary with the level of push-off force and stop-force for the intended user population. Thus, a short board for older users might utilize a smaller piece approximately 0.75 inches thick by 1.5 inches wide by the desired length with only a slight bevel on the edge which contacts the foot. There are numerous contours for the start-stop block where the foot contacts the wood, including but not limited to 90 degrees and virtually any angle. It may also be angled from side to side so that it is not perpendicular to the long edge of the plastic glide surface. There are, of course, many materials other than wood which are satisfactory for use in the end piece. Wood appears to be the most cost effective material.

The gliding surface 2 is the top surface of a thin flexible film with a low coefficient of friction such as PET, typically 0.007 inches to 0.014 inches thick, but not limited to PET or to this specific thickness range. Other suitable films might include polyolefins and polyamids especially as process technologies improve and the materials can be manufactured to lay flat. These inherently difficult to bond films will be suitable for use with the adjustable end piece described in FIG. 5 and FIG. 6. It is essential the film be supple and deflect under load thereby conforming to the mat as the exerciser glides across and presses down into the mat.

The bonding agent 4 may be a suitable rubber based or polyester based adhesive resin which is satisfactory for bonding the wood blocks to the glide surface. Other resins are also satisfactory. Adhesive lamination is probably the most cost effective means to join the plastic surface 2 and the start-stop blocks 1. Other methods may also be used such as screws or a split block with adhesive and screws.

Mat 3 consists of a high density cellular foam or a solid elastomer with a typical thickness range of 0.020 inches to 0.250 inches. The thickness is not limited to this range as a thicker foam could be used if the compression-deflection value of a thicker foam created similar deformation to the thin film and the corresponding resistance values. Typically, thick foams are not as practical as they will increase the size of the package required to transport the device. However, thicker and softer materials will have utility in the octagonal type designs because the higher resistance will increase the workload for a given area, allowing practitioners to use less floor space. SBR and polyurethane foams are two of many chemical formulations which will provide good performance. Physical properties for the mat include good anti-skid values, impact absorption, a range of hardness or compression-deflection values, and good flex fatigue properties. For strength, the foamed cellular materials may be reinforced with netting made of nylon or another reinforcement material.

With regard to solid elastomers for mat 3, these properties are found in SBR/natural rubber blends and many other elastomers. Solid elastomers with a high durometer would be used when hard/fast mats are desired and where the environment dictates higher values for physical properties such as abrasion resistance and moisture resistance.

Other compressible mats will function effectively. For example, an air or liquid filled pack could be utilized.

Figure 4:
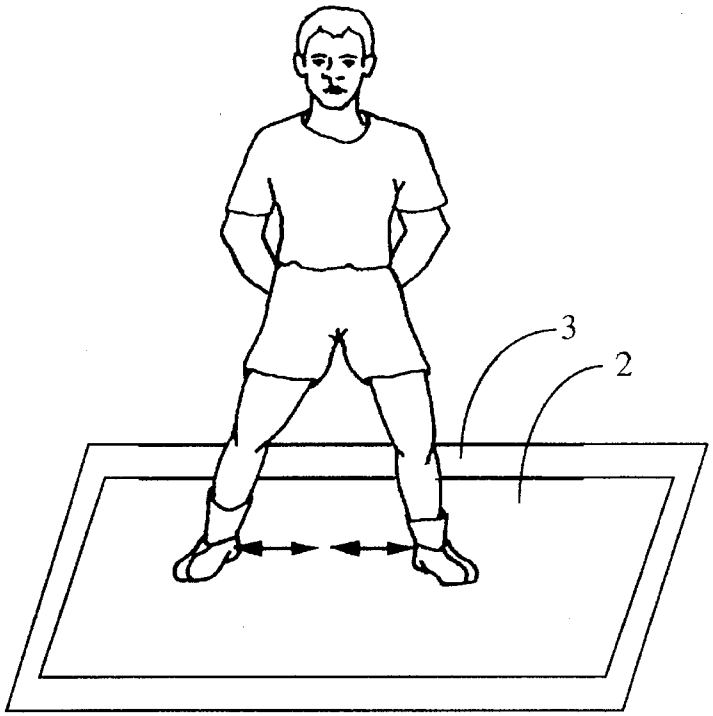
FIG. 4 is a pictorial illustration depicting the use of the device without start-stop blocks.

If, as shown in FIG. 1, the user has a bootie over the shoe and is pushing off the start-stop block 1 with her right foot, she will glide across the plastic surface 2 and then stop when her left foot reaches the start-stop block I on the opposite side. As shown in FIG. 4, only the gliding surface is used in combination with the mat. The movement pictured works the adductors as the exerciser starts with the feet at shoulder width and then pulls the heels together. There are numerous exercises utilizing only the glide sheet and the mat. For example, the booties may be placed on the hands and the exerciser can then work the upper extremities. When used for upper extremities, the sheet 2 and mat 3 may be mounted on a table or a wall.

Assuming a standing position, as the exerciser slides across the plastic surface, the compressible mat 3 will collapse to some degree depending on the user's body weight, contact area of the exercise shoe, and other related factors thereby creating resistance which would not be present with a rigid surface having the same coefficient of friction. By changing the compressibility of the mat 3, the amount of resistance is affected accordingly. A soft mat requires more effort to travel across the board whereas a hard mat requires less effort.

Changing the firmness of the mat 3 where it supports the wooden block allows for more or less impact absorption as the exerciser starts and stops.

By combining sections of mat 3 with different compression-deflection values, specific results can be accomplished. For example, a faster harder mat in the middle of the glide surface with a softer mat starting approximately one foot inside of the wooden blocks allows for a faster and longer glide up to the point where the soft mat is encountered. The higher resistance of the soft mat at the end would create increasing resistance/deceleration as the user approaches the wooden block and prepares to stop. Therefore, the impact force when stopping would be lower. This is only one example of many where the resistance can be adjusted between the start-stop blocks to accomplish specific objectives.

Another example pertains to physical therapy where the practitioner is able start a therapy program with a low resistance mat and increase the resistance as the user, becomes stronger, and is able to work harder. Physical therapists and related practitioners will also find the compressible surface has utility in treating disorders which cannot withstand the impact associated with a rigid surface. Speed skaters could selectively practice on "slow ice" or "fast ice".

The mat 3 may be either of a single layer or multiple layers having different compression-deflection values.

The mat of course could be permanently bonded with adhesive or another suitable means to the plastic gliding sheet. Alternatively, however, the sheet 2 is simply placed on mat 3, so that the mat 3 could readily be replaced by other mats having different characteristics. The mat will also wear more evenly if it is not attached to the plastic sheet. As shown in FIG. 1 mat 3 is slightly oversize with respect to sheet 2 on all four sides. If desired such as for travel purposes, the mat 3 could be slightly undersize with respect to sheet 2.

The invention may be practiced in various manners. For example, the device may be placed on a flexible surface, such as a padded carpet when supported, for example, by a firm base such as a piece of plywood or a rigid sheet of plastic.

It is also possible to practice the invention by having the start-stop blocks i adjustably mounted rather than being permanently mounted. In this manner it is possible to change the location of the blocks I so as to adjust the distance between the start-stop blocks. Adjustable end pieces may also be angled from side to side so that they are not perpendicular to the long edge of the plastic glide surface.

Figure 5:
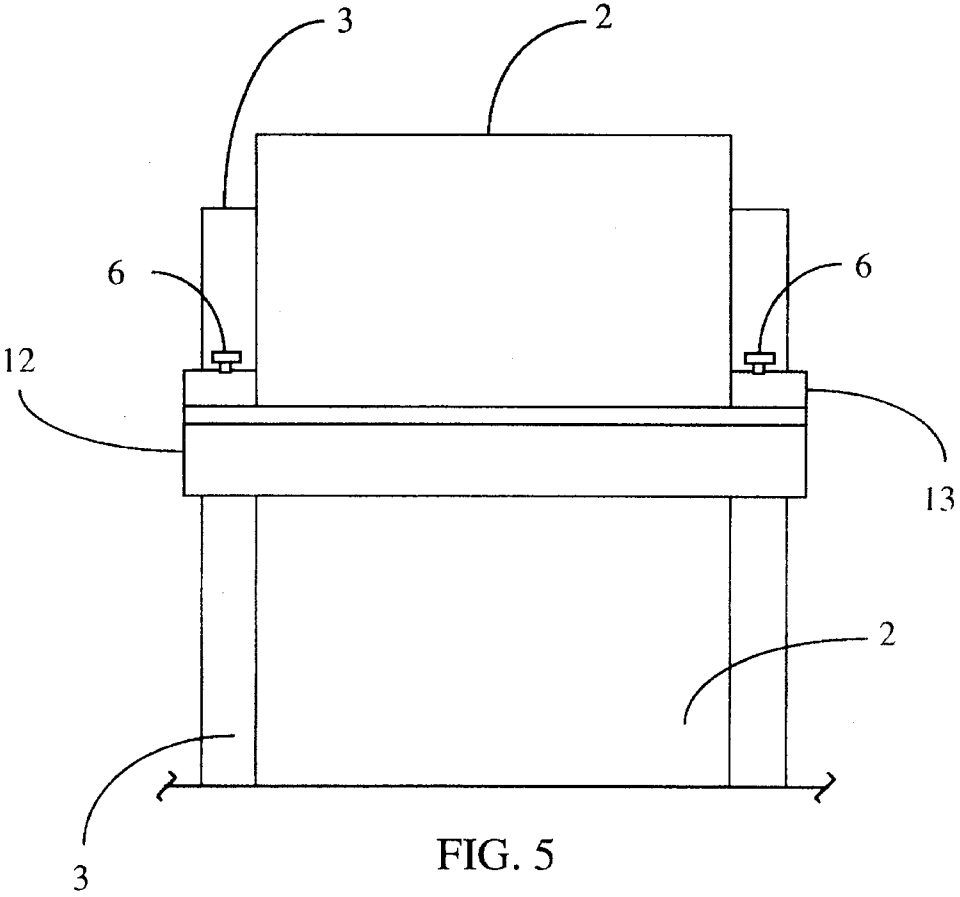
FIG. 5 is a top view of a device with an adjustable start-stop block.
Figure 6:
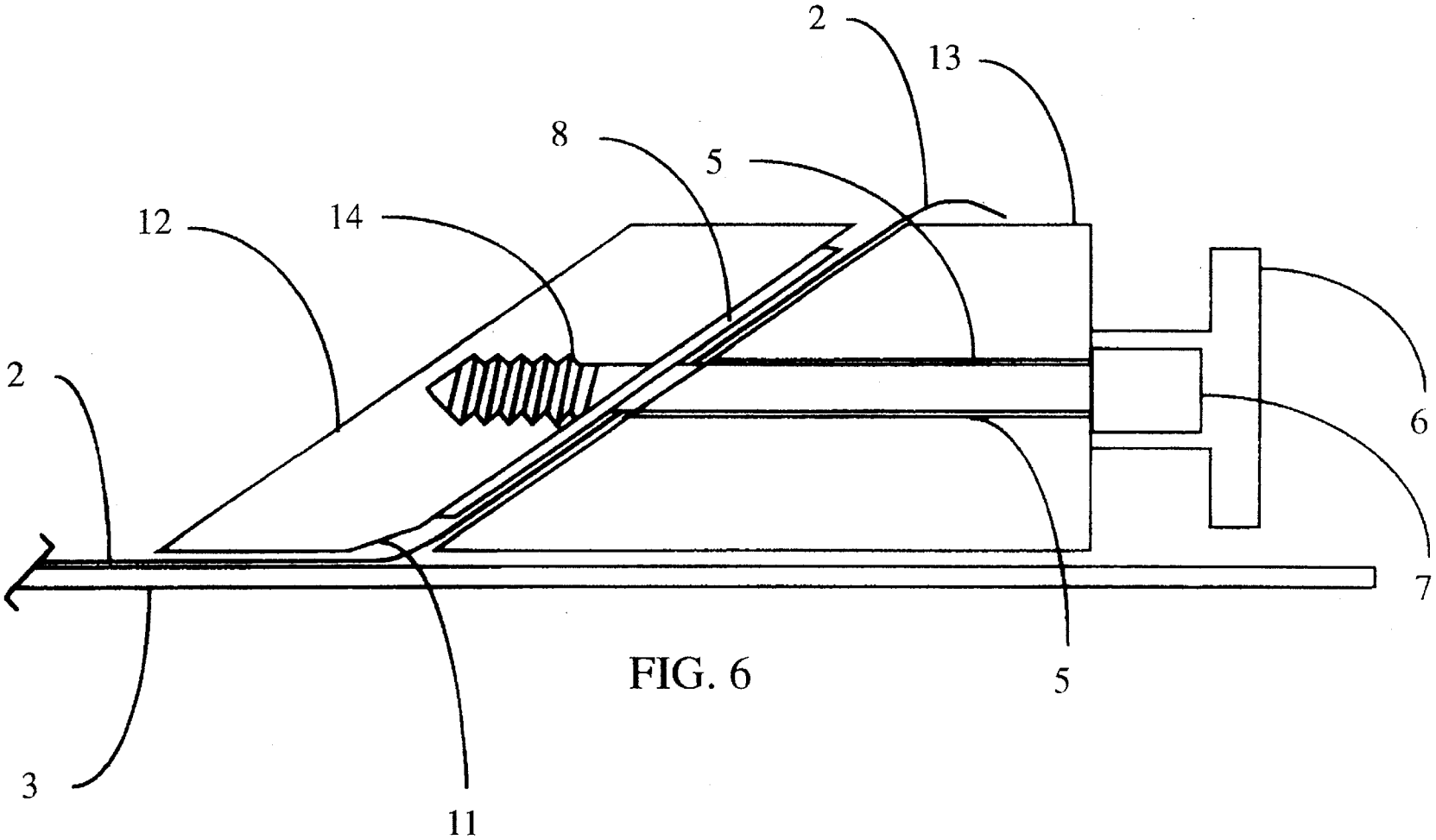
FIG. 6 is a side elevation of a start-stop block that is adjustable.

FIG. 5 depicts a device with an adjustable end piece. Glide sheet 2 passes through contact piece 12 and main body 13. Reference FIG. 6, the assembly consists of an anti-skid/damping pad 8 bonded to contact piece 12. The contact piece 12 with pad 8 is drawn firmly against the main body 13 to secure sheet 2 when knobs 6 with threaded inserts 7, see FIG. 5 and FIG. 6, are tightened on bolts 14 which are threaded into the contact piece 12 and pass through aligned holes 5 in the main body 13. There is bowing/flexing in the middle of the contact piece 12 away from the main body in proportion to the torque on knobs 6. This flexing is functional in that it attenuates impact forces of the user as he/she strikes the contact piece. In practice, the sprung edge of the contact piece returns to its normal flat state and, depending upon the impact force, flexes inwardly toward the main body 13. This inward flexing drives the anti-skid/damping pad 8 against the plastic sheet 2 effectively clamping the plastic sheet 2 and prohibiting any significant movement. The anti-skid/damping layer 8 also reduces impact forces as it is compressed. The materials for the start-stop block specified in the fixed length device are used for the main body 13 and contact piece 12. The top surface of the contact piece 12 is about 1.25 inches, though other dimensions will work. Bevel 11 on the bottom of the contact piece 12 facilitates bending the glide sheet 2 as it turns up and through the assembly. The front and back edges of contact piece 12 are parallel to the slope of the main body. However, similar to the fixed length device of FIG. 1, the front edge of contact piece 12 may consist of numerous contours and virtually any angle. The anti-skid damping pad is made from a high density cellular material such as rubber or urethane though other materials will perform adequately. An anti-skid/damping pad may also be attached to the sloped edge of the main body 13 to further reduce impact forces.

The device is significantly more effective than Braathen's or Carra's vertically oriented designs which have a tendency to move outwardly when the lateral or horizontal forces of the exerciser are greater than the downward force of the vertically oriented fasteners on the upper and lower members which clamp in a horizontal plane. Essentially, the vertical and lateral forces work against one another in these devices.

On the contrary, the lateral force/momentum of the exerciser is used to secure the design depicted in FIG. 6. As the user impacts the contact piece with lateral force, the contact piece 12 moves toward the main body 13 in proportion to the lateral force. This occurs because the bottom edge of contact piece 12 will slide on the glide sheet 2 as the bolts 14 move into the aligned holes 5 which function as a bushing/bearing for bolt 14. As noted above, the flattening and inward movement in the middle of the contact piece 12 also increases in proportion to the lateral forces generated by the exerciser. Simultaneously, the main body 13 is held securely by the mat 3. Thus, the two pieces, 12 and 13, are driven together by the user's lateral force/momentum. As impact forces increase, the anti-skid/damping pad 8 is compressed thereby increasing the effectiveness of the clamp while simultaneously reducing impact forces on the user's body parts. Functionally, lateral/impact forces of exercise are attenuated and used to hold the glide sheet securely. The dynamic interaction of the components yields a low impact device which remains dimensionally stable as lateral/impact forces increase.

If desired, the hole 5 could be fitted with a metal or plastic bushing machined to allow tight clearance with the shaft of bolt 14. Another more expensive construction involves replacing the bolt 14 with a metal dowel or a plastic dowel made from an engineering plastic such as reinforced nylon fitted into a metal or plastic bushing with clamping pressure activated by draw latches on each end. Numerous constructions of the basic concept are possible.

Figure 7:
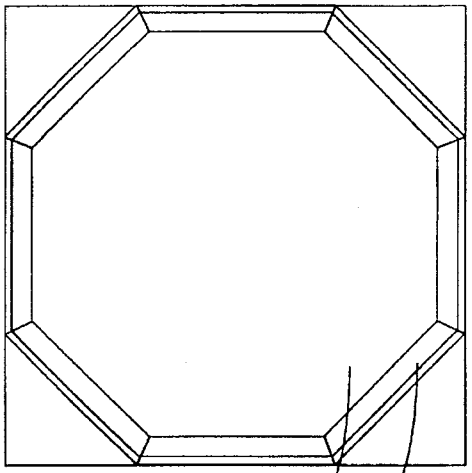
FIG. 7 is a top view of a multi-sided device.

FIG. 7 depicts an octagonal device. Details of the construction appear in FIG. 8. The base consists of interlocking members having three layers. Base 15 has a groove into which the tongue of base 17 is inserted. Post screws 18 hold the base pieces together. Holes 16 are fitted with posts 19. Gliding surface 2 and mat 3 have aligned holes 20, oversize in relation to post 19. Start-stop block 21 has aligned holes to accept post 19. The device is placed on top of anti-skid strips 22.

The base 15 and 17 may consist of layers of luan plywood, rigid plastic, or a similar material bonded with adhesive and mechanical fasteners such as staples if needed. Two layer and single layer designs will work, however, the three layer tongue and groove construction yields a smooth seam where the pieces meet and is easy to set-up and breakdown. The start-stop block materials, mat, and glide surface are the same as for the devices mentioned above. The anti-skid strips 22 are made from the same material as mat 3. Post 19 can be manufactured from numerous metals, plastics, and alloys. A bolt may be used as the post if desired. Numerous constructions can be utilized. For example, post 19 can have a flanged bottom adjoining the underside of the base 15/17. Hole 16 could be fitted with a bushing/bearing. Many variations of the basic design are possible.

Set-up and breakdown can be accomplished in about 10 minutes.

The device can be made adjustable by fabricating the mat 3 and base 15/17 with different patterns for the holes 16. A separate glide sheet 2 and start-stop blocks 21 are fabricated with holes to match the desired pattern. This construction, for example can be expanded from a 4 foot octagon to a six foot octagon in a matter of minutes. Of course, different mats 3 can also be used to affect the desired level of resistance. For example, it will be efficacious to utilize high resistance mats beneath the gliding surface thereby allowing more work on a smaller octagon. A smaller octagon will be practical as less floor space will be required for the device.

The construction outlined could be used for "L" shaped boards, circular boards, as a support for straight boards, and so forth.

To facilitate proper use of the multi-sided device in a cost-effective fashion, the start-stop blocks or adjoining surfaces may be color coded, labeled with numbers, drawings, or similar distinct markings. For safety, if an elevated marker is desired, a soft flexible foam marker could be used. An audio recording could then guide the user from one position to the next. A more expensive system could utilize a micro-processor in combination with lights, buzzers, and so forth.

Figure 8:
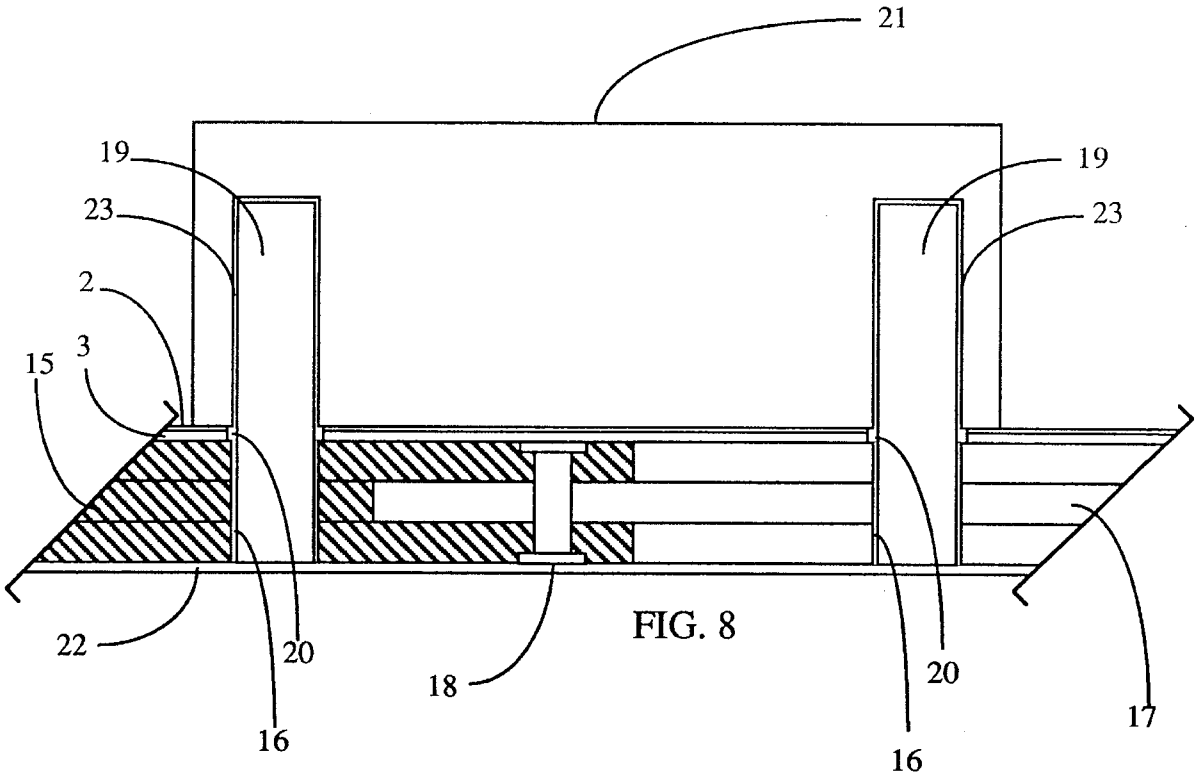
FIG. 8 is a side elevation partly in section depicting the construction of FIG. 7.

The concepts of FIGS. 7–8 could be utilized in various manners. Broadly these concepts involve the use of a plurality of blocks mounted on the gliding surface to define the limits of the gliding area. The blocks may abut each other to form a closed periphery of any desired shape including circular, triangular, square, rectangular, octagonal, or any other multi-sided shape. Additionally, the blocks may form an open configuration including an "L" or a "V" shape.

With regard to practicality, the disclosed devices are simple. With fixed end pieces there are only four components. The total weight of a fixed length seven foot device including a corrugated cardboard box for storage and transportation averages twelve pounds. Just a few moments are required for set-up before the exercise begins and to prepare for storage after the workout is complete. The device is inexpensive to produce and a five foot board with fixed start-stop blocks sells for less than $100.

What is claimed is:

1. A variable resistance slide board comprising a thin flexible sheet having an upper glide surface and a compressible mat having an area about as large as the area of said sheet, said sheet being mounted on and supported by said mat, said sheet being made of a material which is supple and deflectable and deformable under load to conform to said mat, and said mat consisting of sections having different compressibility characteristics.

2. The slide board of claim 1 wherein said mat is of multiple layer construction with said layers comprising said sections having different compressibility characteristics.

3. The slide board of claim 1 wherein said mat is made of at least one layer, and said one layer having said sections of different compressibility characteristics.

4. The slide board of claim 1 wherein said mat is permanently attached to said sheet.

5. The slide board of claim 1 wherein said sheet is detachably mounted on said mat.

6. The slide board of claim 1 in combination with a padded member, a firm base being disposed over said padded member, and said mat being mounted on said firm base.

7. The combination of claim 6 wherein said padded member is a carpet and said firm base is wood or rigid plastic.

8. The slide board of claim 6, wherein anti-skid strips are mounted under said base.

9. The slide board of claim 1 including a rigid base, and said pad and said sheet being mounted on said base.

10. The slide board of claim 9 wherein said rigid base comprises a plurality of interlocked layers.

11. The slide board of claim 1 including a start-stop block or blocks mounted on said glide surface of said sheet for engaging the foot or hand of the user while starting or pushing or stopping.

12. The slide board of claim 11 including a plurality of said blocks around the periphery of said sheet to define the limits of the glide area of said glide surface.

13. The slide board of claim 12 wherein said blocks abut each other to form a closed geometric shape.

14. The slide board of claim 13 wherein said shape is a octagon.

15. The slide board of claim 12 wherein said blocks and said sheet form an open configuration including an "L" and a "V" shape.

16. The slide board of claim 11 wherein said block comprises a front member/contact piece and back member/main body adjacent thereto at a vertical angle, said sheet being adjustably inserted in the space coinciding with the vertical angle between said contact piece and main body to adjust the location of said block with respect to said glide surface, and a horizontal clamping means for pressing said contact piece and said main body together to lock said sheet therebetween.

17. The slide board of claim 16 including an anti-skid damping pad between said contact piece and said main body piece and disposed against said sheet.

18. The slide board of claim 16 wherein said contact piece and said main body piece are bolted together to comprise said clamping means, said contact piece having an inclined foot contact surface, and said contact piece having a beveled lower corner disposed toward said main body piece.

19. The slide board of claim 11 including a rigid base, and said pad, said sheet, and said block or blocks being mounted on said base.

20. The slide board of claim 19 wherein said rigid base comprises a plurality of interlocked layers, and at least one post extending through said base and said pad and said sheet and mounted into a respective block.

21. The slide board of claim 19 wherein anti-skid strips are mounted under said base.

22. The slide board of claim 11 wherein the firmness of said mat at sections below said blocks differs from other sections of said mat.

23. A variable resistance slide board comprising a thin flexible sheet having an upper glide surface and a compressible mat having an area about as large as the area of said sheet, said sheet being mounted on and supported by said mat, said sheet being made of a material which is supple and deflectable and deforms variably in accordance with the compression-deflection characteristics of said mat, said sheet having a pair of oppositely disposed sides, start-stop blocks mounted on said glide surface at each of said sides of said sheet for engaging the foot of the user while starting or pushing or stopping, and said sheet being substantially thinner than said mat to comprise a low coefficient of friction film over said mat.

24. The slide board of claim 23 wherein said mat consists of sections having different compressibility characteristics.

25. The slide board of claim 23 wherein said mat is permanently attached to said sheet.

26. The slide board of claim 23 wherein said sheet is detachably mounted on said mat.

27. The slide board of claim 23 in combination with a padded member, a firm base being disposed over said padded member, and said device being mounted on said firm base.

28. The combination of claim 27 wherein said padded member is a carpet and said firm base is wood.

29. The slide board of claim 23 wherein said start-stop blocks are adjustably mounted on said glide surface to vary the distance between said blocks.

30. The slide board of claim 23 wherein said mat is of multiple layer construction with said layers having different compression-deflection values.

31. The slide board of claim 23 wherein said mat is at least as large as the area of said sheet and completely supports said sheet.

32. The slide board of claim 31 wherein said mat is slightly larger than the area of said sheet.

33. The slide board of claim 23 wherein said mat is slightly smaller than the area of said sheet.

34. The slide board of claim 23 including a rigid base, and said pad and said sheet being mounted on said base.

35. The slide board of claim 34 wherein said rigid base comprises a plurality of interlocked layers.

36. The slide board of claim 34, wherein anti-skid strips are mounted under said base.

37. The slide board of claim 23 including a plurality of said blocks around the periphery of said sheet to define the limits of the glide area of said glide surface.

38. The slide board of claim 37 wherein said blocks abut each other to form a closed geometric shape.

39. The slide board of claim 38 wherein said shape is a octagon.

40. The slide board of claim 37 wherein said blocks and said sheet form an open configuration including an "L" and a "V" shape.

41. The slide board of claim 23 wherein said block comprises a front member/contact piece and back member/main body adjacent thereto at a vertical angle, said sheet being adjustably inserted in the space coinciding with the vertical angle between said contact piece and main body to adjust the location of said block with respect to said glide surface, and a horizontal clamping means for pressing said contact piece and said main body together to lock said sheet therebetween.

42. The slide board of claim 41 including an anti-skid damping pad between said contact piece and said main body piece and disposed against said sheet.

43. The slide board of claim 41 wherein said contact piece and said main body piece are bolted together to comprise said clamping means, said contact piece having an inclined foot contact surface, and said contact piece having a beveled lower corner disposed toward said main body piece.

44. The slide board of claim 23 including a rigid base, and said pad, said sheet, and said block or blocks being mounted on said base.

45. The slide board of claim 44 wherein said rigid base comprises a plurality of interlocked layers, and at least one post extending through said base and said pad and said sheet and mounted into a respective block.

46. The slide board of claim 44 wherein anti-skid strips are mounted under said base.

47. The slide board of claim 23 wherein the firmness of said mat at sections below said blocks differs from other sections of said mat.

* * * * *